US005461725A

United States Patent [19]

Witczak

[11] Patent Number: 5,461,725

[45] Date of Patent: Oct. 31, 1995

[54] GARMENT FOR NURSING WOMAN

[76] Inventor: Pamela A. Witczak, 18620 Tanterra Way, Brookeville, Md. 20833

[21] Appl. No.: 814,506

[22] Filed: Dec. 30, 1991

[51] Int. Cl.[6] ..... A41D 1/20; A41C 3/04

[52] U.S. Cl. ..... 2/104; 2/73; 2/105; 450/7; 450/30; 450/31; 450/32; 450/37; 450/57

[58] Field of Search ..... 2/73, 104, 114, 2/105, 106, 75, 80; 450/31, 32, 34, 35, 36, 37, 39, 40, 57, 7

[56] References Cited

U.S. PATENT DOCUMENTS

| | | | |
|---|---|---|---|
| 1,256,203 | 2/1918 | Cook | 450/57 |
| 1,977,465 | 10/1934 | Aronson | 2/73 |
| 2,019,545 | 11/1935 | Roth | 2/73 |
| 2,211,549 | 8/1940 | Semons | 2/73 |
| 2,221,851 | 11/1940 | Teamer | 2/114 |
| 2,310,855 | 2/1943 | Manson | 450/34 |
| 2,522,010 | 9/1950 | Woodruff | 450/36 |
| 2,593,739 | 4/1952 | Elder | 2/73 |
| 2,685,087 | 8/1954 | Williams | 2/73 |
| 2,726,399 | 12/1955 | Elmore | 2/73 |
| 2,748,771 | 6/1956 | Richards | 450/36 X |
| 2,896,630 | 7/1959 | Adler | 2/114 |
| 3,220,415 | 11/1965 | Marino | 450/86 |
| 3,316,915 | 5/1967 | Howell | 2/73 |
| 3,348,241 | 10/1967 | Dodds | 2/104 |
| 3,356,090 | 12/1967 | Plantinga et al. | 450/37 X |
| 3,422,818 | 1/1969 | Erteszer | 2/73 X |
| 3,677,252 | 7/1972 | Pedley . | |
| 3,811,133 | 5/1974 | Harris | 450/39 X |
| 4,031,566 | 6/1977 | Johnson . | |
| 4,100,621 | 7/1978 | Ettipio | 2/114 |
| 4,184,214 | 1/1980 | Schaper et al. | 450/39 |
| 4,208,743 | 6/1980 | Whitcraft . | |
| 4,412,542 | 11/1983 | Reichert | 128/455 |
| 4,528,699 | 7/1985 | Hughes . | |
| 4,566,136 | 1/1986 | Echols . | |
| 4,633,876 | 1/1987 | Scuillia . | |
| 4,663,782 | 6/1987 | Knox et al. . | |
| 4,957,466 | 9/1990 | Hopps | 450/85 |
| 5,119,511 | 6/1992 | Packer et al. | 450/69 |

FOREIGN PATENT DOCUMENTS

| | | | |
|---|---|---|---|
| 1474228 | 3/1967 | France | 2/73 |
| 0693525 | 7/1940 | Germany | 450/37 |

OTHER PUBLICATIONS

New Beginnings, Jan./Feb. 1991, vol. 7, No. 1, p. 31.
J. C. Penney's Fall/Winter 1991, p. 247.

*Primary Examiner*—Jeanette E. Chapman

[57] ABSTRACT

The garment is provided featuring stretchable, resilient straps and a bodice. The straps are sufficiently resilient and suitably stretchable so that when a women wearing the garment pulls down the bodice, she can expose a breast for nursing and when through, she can return the bodice to its original position covering the breast. Straps and bodice are resilient such that garment regains it as original shape when returned to the original position. In this fashion, a women wearing the garment is able to expose the breast for nursing with one easy motion without having to deal with flaps or buttons or the like. The invention also provides female snap fasteners on the inner surface of the cups so that breast pads may be removeably fixed thereto. Thus, the invention provides a garment which is self sufficient, not requiring a bra for the use of breast pads. Bodice also fits snugly enough to hold nursing pads in place even if they are not snapped in.

18 Claims, 2 Drawing Sheets

GARMENT FOR NURSING WOMAN

BACKGROUND OF THE INVENTION

1. Field of the Invention

This invention pertains to an article of clothing. In particular, it pertains to an article of clothing suitable for a nursing woman.

2. Description of the Prior Art

For many years, women have had trouble finding clothing suitable for wear when nursing babies. What many women want is something comfortable and attractive, yet convenient when actually nursing. That is to say, women want attractive clothing which allows easy exposure of the breast at appropriate times so that nursing can be done conveniently.

Previous attempts to provide suitable clothing for nursing women have typically been characterized by either: 1) a slit-type garment (i.e. a garment featuring slits or vents for exposure of the breast) or; 2) a covering-element-type garment (e.g. a garment featuring patches or flaps or connecting elements such as buttons), interconnecting the garment in such a way that the breast is covered and that a flap can then be lifted or shifted so that the breast can be exposed. Occasionally the prior art exhibits some combination of slit-type garment and flap-type garment.

Slits require either cumbersome adjustment of clothing, or the breast, or both. Also, a slit does not lend itself to any type of form-fitting design. It must be incorporated into an A-line type loose garment.

Patches and flaps are also cumbersome, obvious and often require manipulation of the connecting elements (e.g. buttons) for exposure of the breast.

The awkwardness of the prior designs and the need for dexterous manipulation of the clothing for breast exposure are particularly undesirable features, because a woman preparing to nurse is usually harried by a crying, hungry infant. Furthermore, a woman is often awakened from a deep sleep for the act of nursing, so her dexterity and alertness are diminished, not to mention her patience.

Additionally, the prior art, whether slit-type or flap-type makes no provision for leaking breasts. That is to say, a nursing woman, especially immediately prior to actually nursing, is often expressing milk from her nipples. During the day or night a woman will end up with wet, stained clothing if she does not take the precaution of wearing breast pads or the like. Breast pads typically require a bra to secure them. Hence a woman using a prior art nursing garment also has to contend with a bra (whether it is conventional or a nursing bra) in addition to the garment itself. Thus problems of manipulation requirements and inconvenience are compounded.

What is needed is a single, self-sufficient garment suitable for nursing. Such a garment should be attractive, comfortable, secure, allowing for use of breast pads and yet providing easy exposure of the breast. It would be particularly desirable if the breast could be exposed in one motion without requiring great dexterity in such motion.

SUMMARY OF THE INVENTION

The problems outlined above are in large measure solved by an innovative garment in accordance with the present invention. That is to say, the invention hereof provides an attractive garment which is comfortable, secure and allows convenient exposure of the breast in one easy motion. The present invention provides a bodice with resilient stretch straps so that when the woman pulls down the garment sufficiently, the woman's breast is suitably exposed for nursing the baby. Yet the first and second straps are suitably resilient so that when the bodice is released, the garment substantially resumes its original shape. The bodice is resilient and stretchable so that breast pads can be secured between the breasts and the bodice. In particularly preferred embodiments, the bodice includes snaps on the inner surface for securing breast pads thereat.

The invention optionally provides tapered sleeves for additional aesthetic features and comfort, the sleeves being tapered in a manner which allows for great range of motion, which is especially desirable during sleep. Preferred embodiments also feature elastic lace not only on the straps of the garment but also on the outside of the bodice. The bodice is resilient enough to conform to the breast during pregnancy and post natally.

DETAILED DESCRIPTION OF THE PREFERRED EMBODIMENT

The present invention features a garment for nursing a baby, the garment providing easy motion for breast exposure. The invention also provides for securing breast pads without a bra. Thus the invention provides a garment which is attractive yet convenient and self-sufficient.

Figure 1:
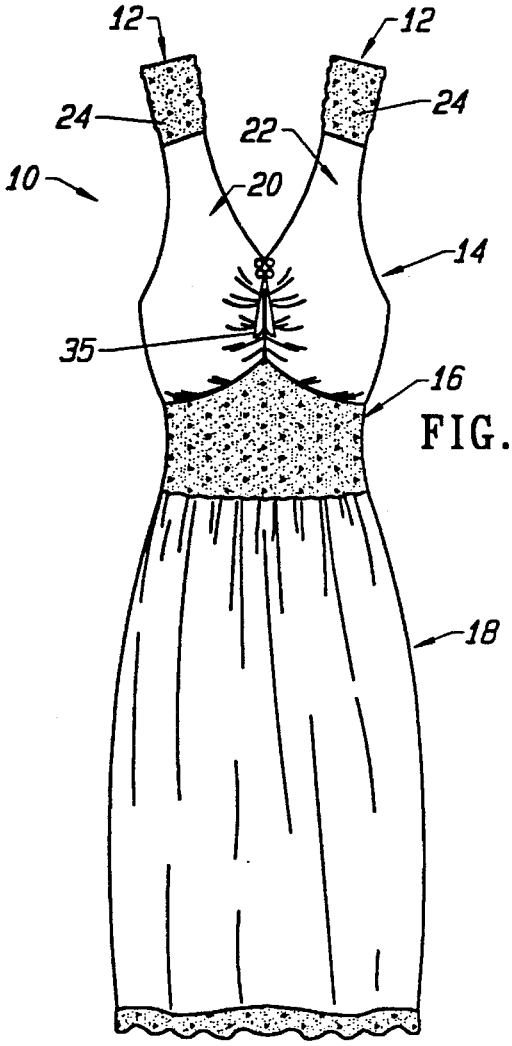
FIG. 1 is a front view of one embodiment of a garment in accordance with the present invention.

Referring now to the drawings in general, and FIG. 1 in particular, a garment 10, suitable for use by a woman nursing a baby, includes straps 12, bodice 14, lower band or fitted waist 16, and skirt 18. Bodice 14 is V-necked and features a left cup 20 and a right cup 22 (as viewed looking on).

Straps 12 are made of elastic lace or any other stretchable, resilient material suitable for the functions described herein. Straps 12 can be made of a different material from bodice 14 or can be integral with and made from the same material as bodice 14 as long as the material straps 12 are made of is suitable for the stretching and resiliency characteristics necessary therefor. Each strap 12 has a front end 24 and a back end 26 (see FIG. 2).

Figure 2:
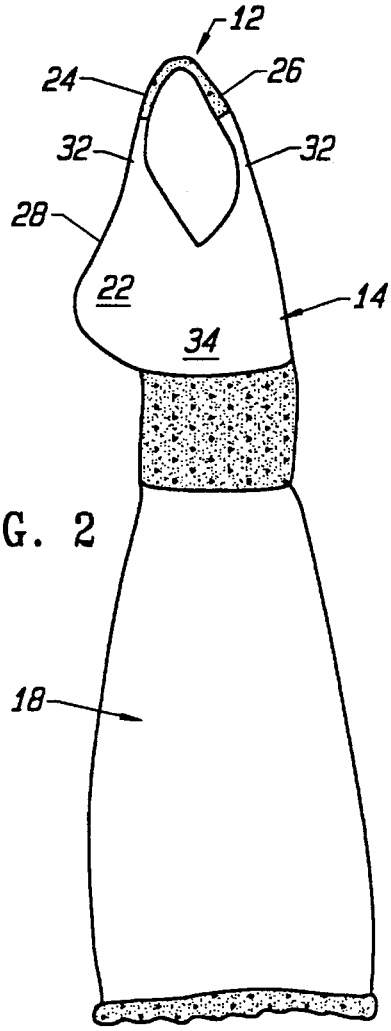
FIG. 2 is a side view of the garment shown in FIG. 1.

Referring to FIG. 2, bodice 14 has a front 28 and a back 30, as well as a top portion 32 and a bottom portion 34. Front end 24 of each strap 12 is connected to each top portion 32 in the front 28 of bodice 14, while each back end 26 is connected to top portion 32 of bodice 14 in back 30. Bodice 14 is made to exhibit good horizontal stretch, in order to perform the functions described herein.

Garment 10 is made in three different sizes with three respective bodice sizes. Each bodice cup presents a length.

The length of the bodice cup is measured from lower band 16 to the point where top portion 32 of bodice 14 meets front end 24 of strap 12. The length of the large bodice cup is about nine inches. The length of the medium bodice cup is about eight and three quarters inches. The length of the small bodice cup is about eight and one half inches.

Left cup 20 and right cup 22 of bodice 14 are not cups per se, but rather are formed by elastic shirring 35 (see FIG. 1) down center of bodice between cups 20, 22. Lower band 16 serves to hold bodice 14 in place on the body of the wearer as well as to form cups 20, 22. Lower band 16 of bodice 14 is preferably about two inches wide for empire style (see FIG. 6) and preferably about five inches wide for the fitted-waist style (see FIGS. 1 and 5). The empire style can be worn throughout pregnancy as well as for nursing, providing extra support for breasts to help eliminate or minimize sagging.

Figure 3:
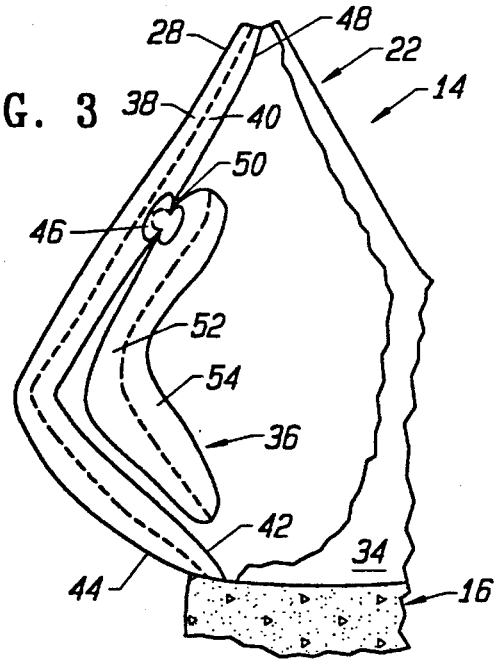
FIG. 3 is a partial, detailed, cutaway view depicting the garment as shown in FIG. 2.

Referring now to FIG. 3, a portion of garment 10 is shown in detail in the side view of FIG. 2. In particular, a cutaway view of right cup 22 of bodice 14 is shown with a nursing pad or breast pad 36 and a portion of fitted waist 16. In particular, right cup 22 is cut away to reveal a first layer 38 and a second layer 40 of base material for bodice 14. The base material is preferably cotton or tricot, but other suitably soft, resilient materials with horizontal stretch could be used, as is well known in the art. By way of example, bodice 14 could be made of spandex or lycra.

The phantom line between first layer 38 and second layer 40 delineates the two layers and highlights the use of two layers for resiliency and comfort. The thickness of the two layers together can prevent the woman's nipples from being visible even when a bra or breast pads are not worn therewith.

Right cup 22 presents an inner surface 42 and an outer surface 44. A snap-socket, female snap member 46 is affixed to inner surface 42 of right cup 22 at an upper portion 48 of inner surface 42 of each cup (only the upper portion 48 of right cup 22 being shown in FIG. 3). Female snap member 46 is located three and three quarters inches down from the point where front end 24 of strap 12 is connected to top portion 32 in the front 28 of bodice 14, substantially laterally centered in cup 22 (see also FIGS. 2 and 4). Another female snap member 46 is analogously positioned in cup 20 (see FIG. 4).

Nursing pad 36 features a male stud snap member 50 which is removably secured to right cup 22 at female snap member 46. Nursing pad 36 also has a first layer 52 and a second layer 54 of base material. Nursing pads are typically made of several layers as is well known, but nursing pad 36 is illustrated with layers 52, 54 only, for ease of illustration. First layer 52 is preferably moisture-repellent while second layer 54 (and any intervening layer) is absorbent. First layer 52 is preferably flesh-toned to enhance the hiding capability mentioned with respect to layers 38, 40 of bodice 14.

Figure 4:
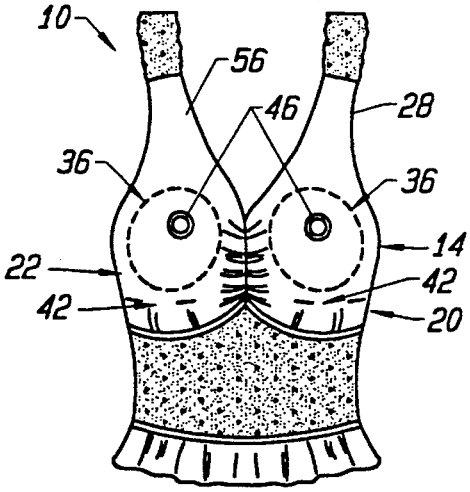
FIG. 4 is a cutaway view of the front inner surface of the garment of FIG. 1.

Referring to FIG. 4, a cutaway view shows inner surface 56 of the front 28 of bodice 14, as well as other portions of garment 10. Note that since this is an inside view, the relative positions of left cup 20 and right cup 22 are reversed. Pads 36 are shown in phantom so that female snap members 46 are visible.

Referring again to FIG. 1, skirt 18 can be of any suitable material, and of course any color can be used. The color, shape, and choice of material are primarily dictated by esthetics and comfort in a general sense.

Figure 5:
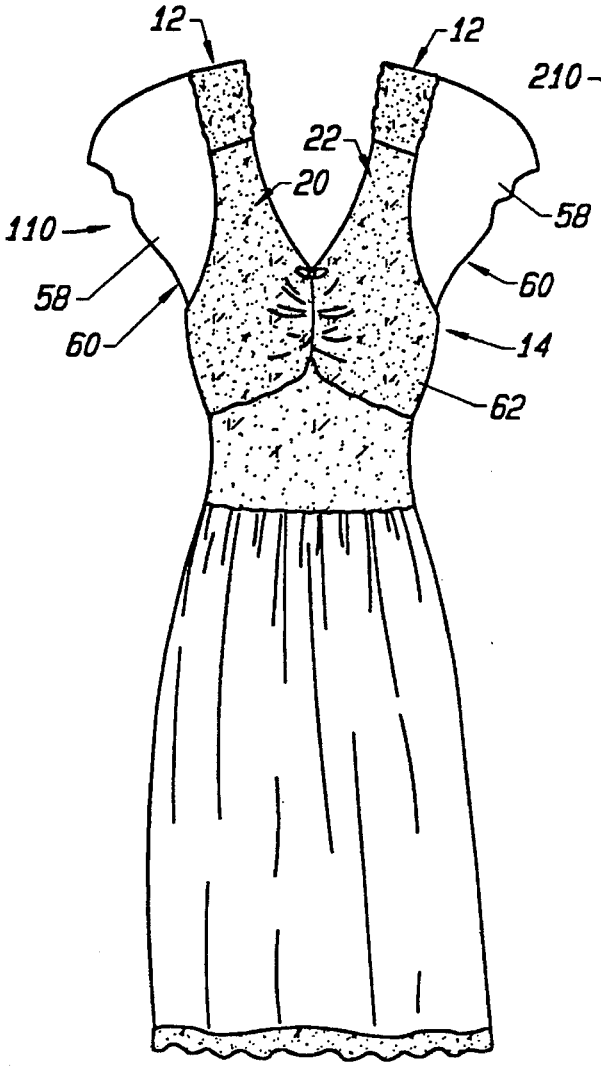
FIG. 5 is another embodiment of a garment in accordance with the present invention.

Referring to FIG. 5, another embodiment of the present invention is shown wherein the primary difference is that garment 110 features sleeves 58, which are tapered in a cutaway fashion as indicated by reference numerals 60. Sleeves 58 are thus tapered for comfort and range of movement, particularly during sleep and while handling a child. Yet sleeves 58 are also aesthetically desirable if the woman prefers to hide her shoulders or upper portions of her arms. Note also that garment 110 features elastic lace 62 on the outer surface 44 (not shown in FIG. 5) of left cup 20 and right cup 22 and indeed over the entire extent of bodice 14.

Each sleeve 58 is gathered onto the respective stretch strap 12 (strap 12 is actually stretched to full capacity as sleeve 58 is sewn to it) so sleeve 58 does not interfere in any way with the pull-down function of bodice 14. Sleeves 58 can be longer or shorter in a given design but the manner in which they are secured to straps 12 does not change.

Figure 6:
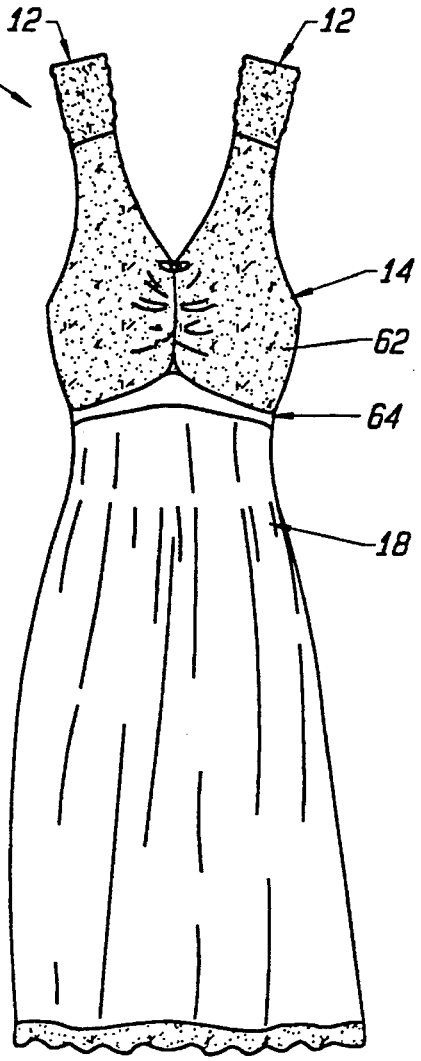
FIG. 6 is yet another embodiment of a garment in accordance with the present invention.

FIG. 6 features a garment 210 having elastic lace 62 on the outer surface 44 (not shown in FIG. 6) of bodice 14 in a strictly analogous fashion, but garment 210 is sleeveless and provides an empire-style lower band 64, (i.e. no fitted waist).

Figure 7:
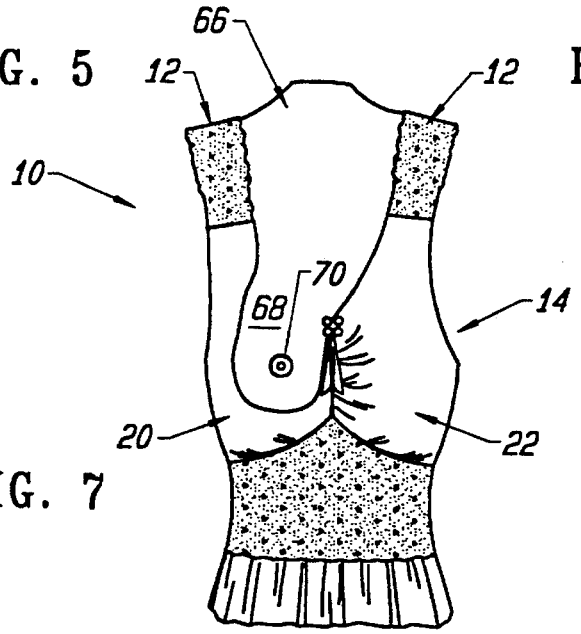
FIG. 7 is a partial view of a woman wearing the garment of FIG. 1 , depicting the technique of breast exposure in accordance with the present invention.

Referring to FIG. 7, garment 10 of FIG. 1 is shown once again, illustrating a beneficial aspect of the invention. A woman 66 is partially shown with one breast 68, including nipple 70, exposed. To achieve this position, the woman 66 simply pulls left cup 20 slightly out and down to expose breast 68. Note resilient straps 12 deform and elongate slightly to accommodate this motion. Left cup 20 is simply held under breast 68 by the contour and fold of the breast 68 itself.

Thus access to breast 68 and nipple 70 is achieved and the baby (not shown) is nursed. When the nursing session is over, the woman 66 simply grasps cup 20 and pulls it over breast 68. Of course the same procedure can be used with right cup 22 as well, if a longer nursing session is desired. Bodice 14 and straps 12 resiliently return to the original shape of FIG. 1 when cups 20, 22 are returned to the original position. Bodice 14 firmly yet comfortably supports the woman's breasts while also giving greater support on the sides of the breasts than a conventional bra. Hence garment 10 is particularly suitable as a night gown without a bra (although a bra can be worn if desired). All of the preceding comments apply equally well to garments 110 and 210 but for simplicity of discussion only garment 10 was discussed.

with or without elastic lace 62 (compare FIG. 1 with FIGS. 5 and 6) bodice 14 is made of material with sufficient horizontal stretch to allow it to conform to the breast size. In this fashion the breasts are comfortably yet snugly secured in bodice 14 when larger (e.g. before nursing, when the breasts are engorged with milk). Also bodice 14 conforms to the breasts when they are relatively smaller (e.g. when the breasts are drained at the conclusion of a nursing session). Bodice 14 thus also accommodates changes in breast size during pregnancy due to the resiliency of the first and second layers 38, 40 of the base material of bodice 14, as well as the elastic lace material 62 of bodice 14.

Another particularly beneficial aspect of the invention is that garment 10 (these comments also apply to garment 110, 210) holds breast pads 36 without a bra. Cups 20, 22 are large enough to hide breast pads 36 from outside view yet still fit snugly enough to hold pads 36 securely in place. Also comfort is enhanced because there are no seams on inner surfaces.

Fitted bodice 14, which reveals some breast cleavage, together with either the empire or fitted waist, provides the nursing woman with an attractive, heretofore unavailable style option. Prior art gowns are not fitted in any fashion;

therefore they hide the woman's figure rather than enhance it.

Although the invention has been described in detail herein with reference to its preferred embodiment and certain described alternatives, it is to be understood that this description is by way of example only, and is not to be construed in a limiting sense. It is to be further understood that numerous changes in the details in the embodiments of the invention, and additional embodiments of the invention, will be apparent to, and may be made by, persons of ordinary skill in the art having reference to this description. It is contemplated that all such changes and additional embodiments are within the spirit and true scope of the invention as claimed below.

What is claimed is:

1. A garment suitable for use by a woman nursing a baby, the woman having a right breast and a left breast, each breast presenting a respective size and shape, the garment comprising:

a bodice having a front and a back and further having a top portion and a bottom portion, the front having a central portion, and the bodice substantially made of a resilient, stretchable material;

a stretchable, resilient first strap having a front end connected to the top portion in the front, and a back end connected to the top portion in the back; and a stretchable, resilient second strap having a front end connected to the top portion in the front, and a back end connected to the top portion in the back, whereby the first and second straps are substantially made of suitably stretchable material so that when the woman pulls down the bodice sufficiently, at least one breast of the woman is suitably exposed for nursing the baby, and yet the first and second straps are suitably resilient so that when the bodice is released, the garment resumes its original shape.

2. The garment of claim 1 wherein the bodice additionally includes a bottom band disposed adjacent the bottom portion.

3. The garment of claim 2 further comprising:

a skirt member connected to the bodice at the bottom band.

4. The garment of claim 3 wherein the bottom band presents a width of about two inches, the bottom band formed to an empire style.

5. The garment of claim 3 wherein the bottom band presents a width of about five inches, the bottom band formed to a fitted waist style.

6. The garment of claim 1 further comprising: a resilient stretchable bottom band disposed adjacent the bottom portion of the bodice, the bodice including resilient, stretchable shirring disposed on the central portion of the front of the bodice, the shirring and the bottom band cooperatively forming a right cup and a left cup, so that when the woman wears the garment, each cup resiliently conforms to the size and shape of the respective breast.

7. The garment of claim 6 wherein the right cup and the left cup each present respective inner and outer surfaces, the inner surface of each cup having an upper portion, and wherein a snap member is disposed on the upper portion of the inner surface of each cup.

8. The garment of claim 7 wherein a breast pad is removably snapped on each of the snap members, the respective outer surface of each cup large enough to substantially hide the respective breast pads from view when the woman wears the garment.

9. The garment of claim 7 wherein the respective inner surfaces are seamless.

10. The garment of claim 1 wherein the front of the first and second straps each substantially include elastic lace.

11. The garment of claim 1 wherein the bodice presents an outer surface and the front of the bodice further substantially includes elastic lace disposed adjacent the outer surface thereof.

12. The garment of claim 1 wherein the bodice substantially includes a double-layered base material.

13. The garment of claim 12 wherein the double-layered base material substantially includes cotton.

14. The garment of claim 12 wherein the double-layered base material substantially includes tricot.

15. The garment of claim 1 wherein said bodice is substantially made of spandex.

16. The garment of claim 1 further comprising:

a first sleeve connected to the bodice at the top portion thereof; and a second sleeve connected to the bodice at the top portion thereof, the first and second sleeves disposed on opposite sides of the bodice with respect to one another, both sleeves having respective lower portions which are recessed.

17. A garment for wear by a woman having a right breast and a left breast, each breast presenting a respective size and shape, the garment comprising:

a bodice having a front and a back and further having a top portion and a bottom portion, the front having a central portion, and the bodice substantially made of a resilient stretchable material; and a resilient, stretchable bottom band disposed adjacent the bottom portion of the bodice, the bodice including resilient, stretchable shirring disposed on the central portion of the front of the bodice, the shirring and the bottom band cooperatively forming a right cup and a left cup, so that when the woman wears the garment, each cup resiliently conforms to the size and shape of the respective breast.

18. The garment of claim 17 further comprising:

a stretchable, resilient first strap having a front and connected to the top portion in the front, and a back end connected to the top portion in the back; and a stretchable, resilient second strap having a front end connected to the top portion in the front, and a back end connected to the top portion in the back.

* * * * *